US006244899B1

(12) United States Patent
Bogursky et al.

(10) Patent No.: US 6,244,899 B1
(45) Date of Patent: Jun. 12, 2001

(54) CONTINUOUS CARRIER TO SMT PINS

(75) Inventors: Robert M. Bogursky, Encinitas; Peter V. Bellantoni, Vista; Jerome L. Weber, Escondido, all of CA (US)

(73) Assignee: Autosplice, Inc., San Diego, CA (US)

( * ) Notice: Subject to any disclaimer, the term of this patent is extended or adjusted under 35 U.S.C. 154(b) by 0 days.

(21) Appl. No.: 09/520,775

(22) Filed: Mar. 8, 2000

(51) Int. Cl.[7] ..... H01R 13/40
(52) U.S. Cl. ..... 439/590; 439/937; 206/713
(58) Field of Search ..... 439/590, 937, 439/885; 29/883, 884; 206/716, 714, 713

(56) References Cited

U.S. PATENT DOCUMENTS

| | | | | |
|---|---|---|---|---|
| 3,841,472 | * | 10/1974 | Fuller et al. | 206/329 |
| 4,418,815 | * | 12/1983 | Anderson et al. | 198/476 |
| 5,775,945 | * | 7/1998 | Biance et al. | 439/590 |
| 5,884,773 | * | 3/1999 | Rudi | 206/713 |
| 5,975,952 | * | 11/1999 | McCartin | 439/590 |
| 6,029,814 | * | 2/2000 | Ohuchi | 206/347 |

* cited by examiner

*Primary Examiner*—Gary F. Paumen
*Assistant Examiner*—Ross Gushi
(74) *Attorney, Agent, or Firm*—Michael H. Jester

(57) ABSTRACT

A plurality of discrete SMT pins are carried in bandoleer fashion. Each SMT pin has a base formed on its underside with solder flux vapor venting channels and a shaft with a longitudinal axis connected to the base. A consecutive series of identical pin holding segments are arranged in side-by-side or end-to-end fashion to provide a flexible strip windable about a reel. The strip is continuously injection molded of plastic as a plurality of strings each made up of a predetermined number of part holding segments with a forward portion of each string, except for leading string of the strip, being molded over a trailing portion of a preceding string. Each pin holding segment has a receptacle formed by a pair of opposing resilient fingers for frictionally removably holding a shaft of a corresponding SMT pin so that the pin can be inserted and removed in a direction substantially normal to the longitudinal axis of its shaft. Each pin holding segment is configured as a substantially rectangular body spaced from and parallel to an adjacent pin holding segment. At least one shoulder of each body provides a drive surface for engagement by a drive member or sprocket of a feeder for advancing the strip in an automatic pick and place machine.

11 Claims, 5 Drawing Sheets

CONTINUOUS CARRIER TO SMT PINS

BACKGROUND OF THE INVENTION

The present invention relates to assembly line production of circuit boards, and more particularly, to continuous carriers for connectors adapted for soldering to surface mount technology ("SMT") circuit boards.

Conductive pins and posts have long been used for connecting leads, terminals and electronic components to conductive traces or other devices mounted on printed circuit boards ("PCBs") and in some cases, for connecting one PCB to an adjacent PCB. In recent years pins and posts have been developed for SMT applications. Pins have been provided with a base or head that is precisely placed on a solder pad by a pick and place machine. Usually multiple-pins are rapidly placed in succession on an SMT cicuit board. After solder re-flow, the upper ends of the pins can be used to attach wires, leads, devices or another PCB in parallel relationship.

Tape and reel supply of small discrete parts such as electrical and mechanical components for automatic pick and place onto a PCB, SMT circuit board or other substrate is widely used in the electronics industry. Examples of pick and place machines are those commercially available from Universal, Panasonic, Fuji and others. Typically the pick and place machines have multiple removable parallel feeders which each support a tape reel carrying a different component. An example of such a feeder is the MPF856 commercially available from Hover-Davis, Inc. In one carrier tape system commercialized by Advantek and 3M a plastic carrier tape with sprocket holes along one or both side edges is embossed to form a series of pockets which each carry a separate component covered by a continuous strip. The carrier tape is unreeled, its cover strip is peeled back, and a pick and place head removes a component from each pocket that is adapted for surface mount or through hole attachment. The component is placed under precise computer control onto a given location on a PCB. The PCB usually has solder paste applied at precise locations which temporarily holds the component in place until solder re-flow. It would be impractical to elongate the pockets sufficiently to receive pins in a vertical orientation. Furthermore, even if the pocket could be drawn deep enough, such an arrangement would not position the head of the pin accurately enough for suction pick-up by the nozzle of the pick and place machine.

The use of hoppers or bins for feeding pins to a conventional pick and place machine is undesirable because of the substantial room that they occupy, their tendency to jam, and difficulties in reliably picking up individual pins with the head of the pick and place machine. It is also not desirable to supply pins to a conventional pick and place machine in individual pockets of a continuous carrier tape due to problems in retrieving the pin in the proper orientation with the head of the pick and place machine for subsequent vertical placement on the SMT circuit board. While the AUTOPAK continuous carrier tape product is well suited for many applications, it does require that the part be over-molded with respect to at least one tape. Such over-molding is not practical with metal pins which are often cold formed. It would therefore be desirable to provide a continuous carrier for pins that would be suited for use in conventional pick and place machines which would not require that the pins be over-molded by the continuous carrier.

SUMMARY OF THE INVENTION

The present invention provides a continuous carrier of a plurality of discrete parts each having an axis. A series of part holding segments is continuously molded in side-by-side or end-to-end fashion to provide a strip windable about a reel. At least some of the segments have at least one receptacle that removably holds a corresponding one of the parts so that the part can be inserted and removed in a direction non-parallel to the axis of the part.

The preferred embodiment of our continuous carrier of parts comprises a plurality of discrete SMT pins each having a base and a shaft with a longitudinal axis connected to the base. A consecutive series of identical pin holding segments are arranged in side-by-side or end-to-end fashion to provide a flexible strip windable about a reel. The strip is continuously injection molded of plastic as a plurality of strings each made up of a predetermined number of part holding segments with a forward portion of each string, except for leading string of the strip, being molded over a trailing portion of a preceding string. Each pin holding segment has a receptacle formed by a pair of opposing resilient fingers for frictionally removably holding a shaft of a corresponding SMT pin so that the pin can be inserted and removed in a direction substantially normal to the longitudinal axis of its shaft. Each pin holding segment is configured as a substantially rectangular body spaced from and parallel to an adjacent pin holding segment. At least one shoulder of each body provides a drive surface for engagement by a drive member or sprocket of a feeder for advancing the strip in an automatic pick and place machine.

DESCRIPTION OF THE PREFERRED EMBODIMENTS

Figure 1:
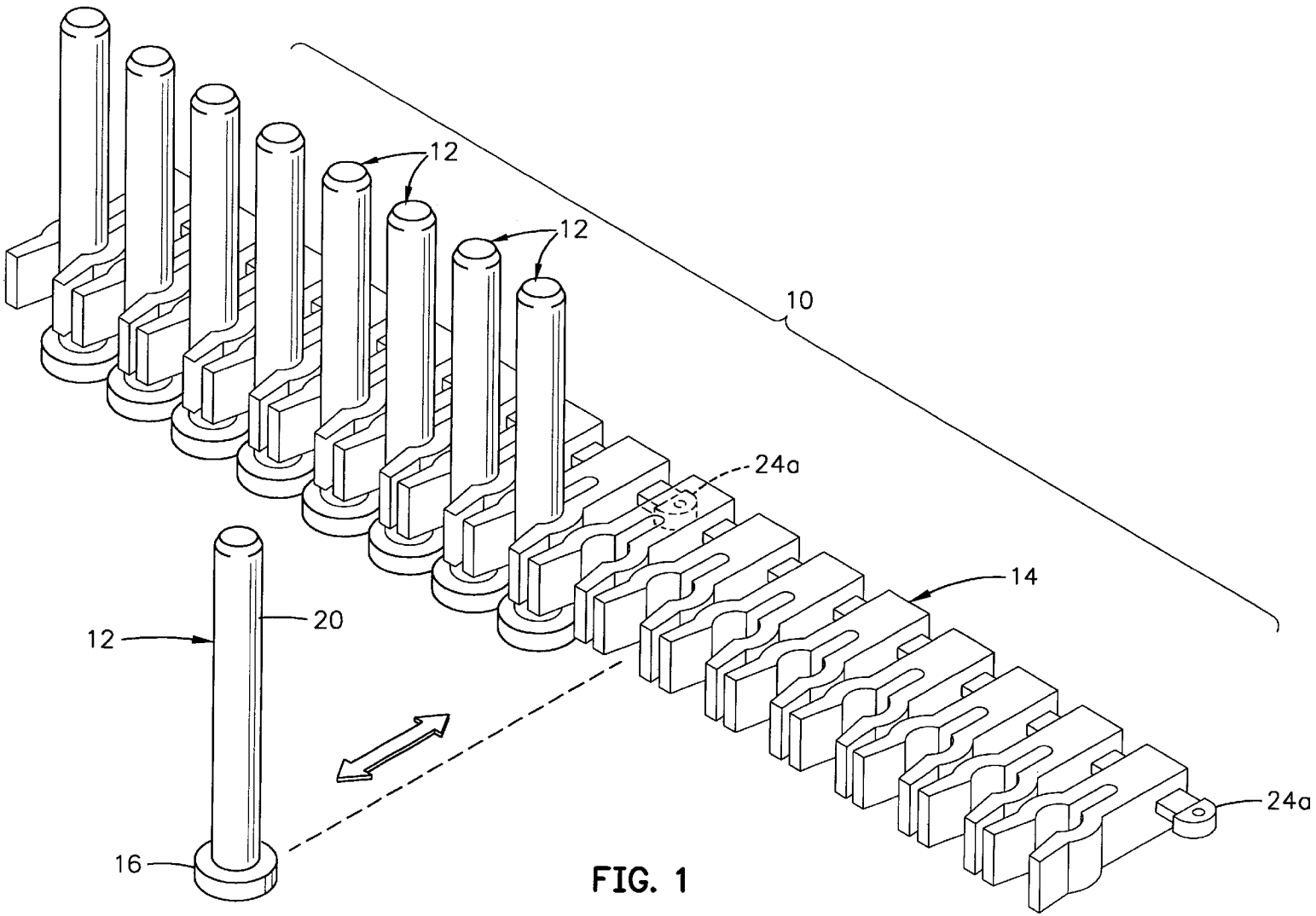
FIG. 1 is an enlarged fragmentary perspective view of a length of a continuous carrier of parts that may be used to temporarily hold and advance parts in the form of SMT pins in an automatic feeder of a pick and place machine in accordance with the present invention.

Referring to FIG. 1, a segment of a continuous carrier of parts 10 is illustrated that includes a plurality of discrete parts in the form of SMT pins 12 which are removably carried in a continuous strip 14. Each SMT pin 12 has a base 16 formed on its underside with radially extending solder flux vapor venting channels 18 (FIG. 3) and a shaft 20 (FIG. 2) connected to the base 16 and having a longitudinal axis 22.

Figure 2:
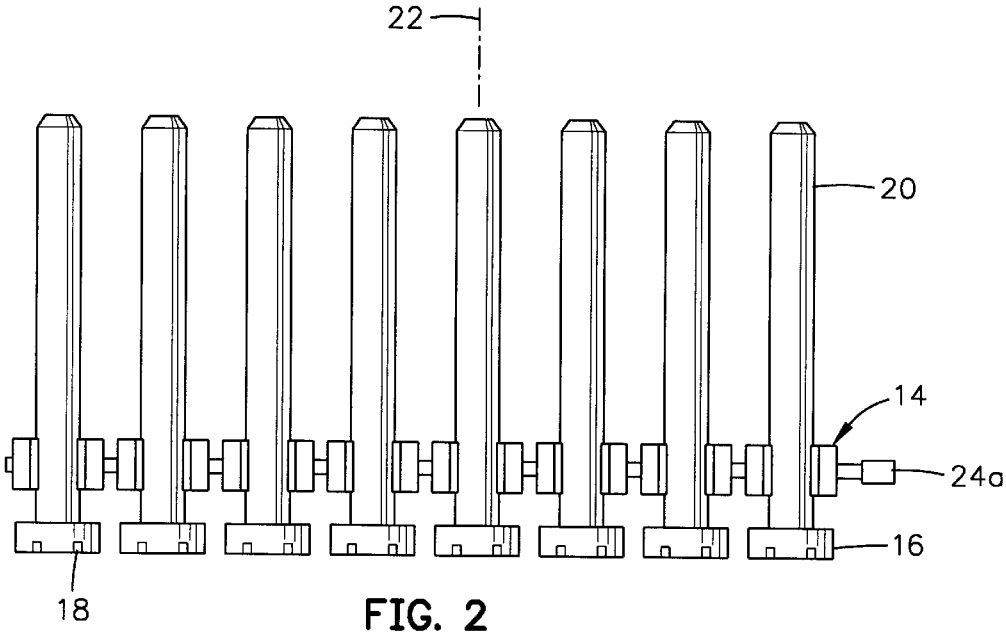
FIG. 2 is a side elevation view of the portion of the continuous carrier having SMT pins taken from the left side of FIG. 1.
Figure 5:
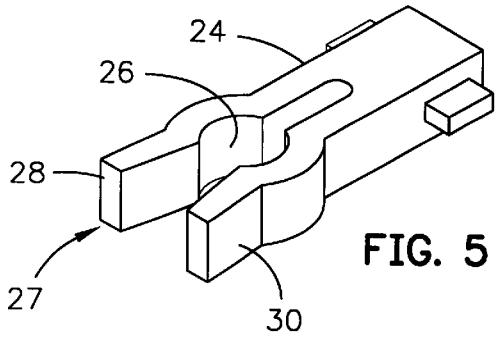
FIGS. 5 and 6 are perspective views of one of the pin holding segments of the continuous carrier of FIGS. 1–4 taken from two different angles to show details of its structure. Its trailing portion that is molded over has been severed off in these views.
Figure 6:
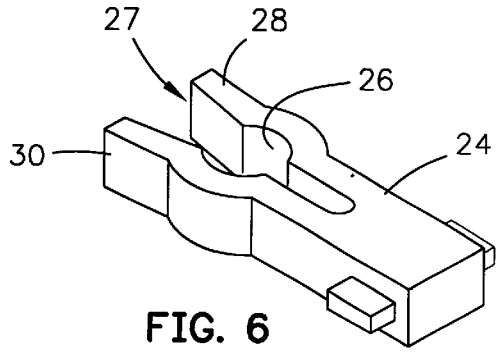

A consecutive series of identical pin holding segments 24 (FIGS. 5 and 6) is continuously injection molded of plastic in side-by-side or end-to-end fashion to provide a strip windable about a reel (not illustrated). Each pin holding segment 24, except for leading pin holding segment of the strip, is connected to a preceding pin holding segment. There are numerous ways to form a long length of the carrier strip 14. This is preferably accomplished by initially molding a string of a predetermined number of pin holding segments 24, for example eight pin holding segments 24, at the same time in a multi-cavity mold. The mold is configured so that the terminal one of the pin holding segments 24 of the string of eight is formed with a trailing portion 24*a* (FIG. 2). The trailing portion 24*a* has a straight leg segment and terminates in a half-circle body with a hole in the same. The configuration of the trailing portion 24*a* ensures that the part holding segment 24 that is molded over the trailing portion 24*a* will flow through the hole in the trailing portion 24*a* to provide an interlock. In addition, the relatively smaller cross-section of the straight segment of the trailing portion 24*a* ensures that the strip 14 is sufficiently flexible so that the strip 14 can be wound around a reel.

Once the string of eight pin holding segments 24 has hardened they are lifted out of the multi-cavity mold and advanced so that the terminal pin holding segment 24 is positioned in the leading cavity of the mold. The next string of pin holding segments 24, consisting of seven pin holding segments 24, is then molded such that the leading pin holding segment 24 of this string of seven pin holding segments 24 is molded over the trailing portion 24*a* of the last pin holding segment 24 of the string of eight pin holding segments. This process is repeated over and over and a long length, for example three hundred feet, of continuously molded and connected pin holding segments 24 that make up the strip 14 is thus produced.

Further details of the over-molding process are disclosed in U.S. Pat. Nos. 5,616,053; 5,957,725; and 5,967,841, the entire disclosures of which are incorporated by reference. The aforementioned patents are all assigned to Autosplice Systems, Inc., the assignee of the subject application.

Each pin holding segment 24 (FIGS. 5 and 6) has a receptacle 26 formed by a fork or clevice 27 made up of a pair of opposing resilient fingers 28 and 30 for frictionally removably holding a shaft 20 of a corresponding SMT pin 12. The fingers 28 and 30 are each formed with arcuate recesses of a diameter matching that of the shaft 20 for define the receptacle 26. The pin 12 can be inserted and removed in a direction non-parallel (e.g. substantially normal to) the longitudinal axis 22 of its shaft 20. The lateral pin removal is performed by an actuating member of an automatic feeder (not illustrated).

Figure 3:
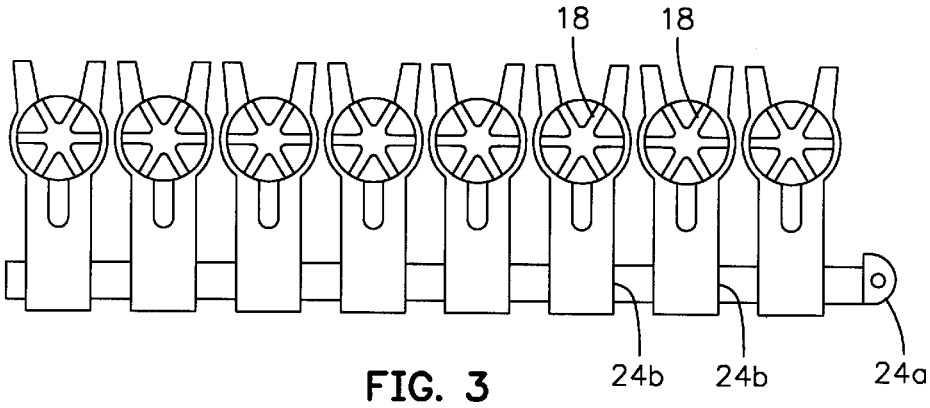
FIG. 3 is a bottom plan view of the portion of the continuous carrier of parts taken from the bottom of FIG. 2.
Figure 4:
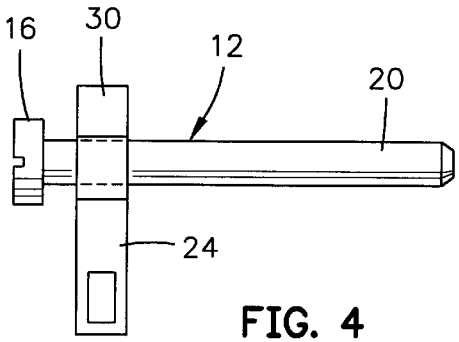
FIG. 4 is a side elevation view of one of the pin holding segments and its inserted SMT pin.

Each pin holding segment 24 is configured as a substantially rectangular body that is spaced from, and parallel to, an adjacent pin holding segment 24 as best seen in FIGS. 2 and 3. At least one shoulder 24*b* (FIG. 3) of each body provides a drive surface for engagement by a drive member or sprocket of the feeder for advancing the strip 14 in a conventional automatic pick and place machine (not illustrated).

After the pins 12 are automatically inserted into each fork 27, a substantial length, e.g forty feet, of the continuous carrier 14, may be cut off, reeled and mounted in the feeder. Due to its flexibility, this substantial length of carrier 14 may be wound about the reel which is mounted in the feeder.

Figure 7:
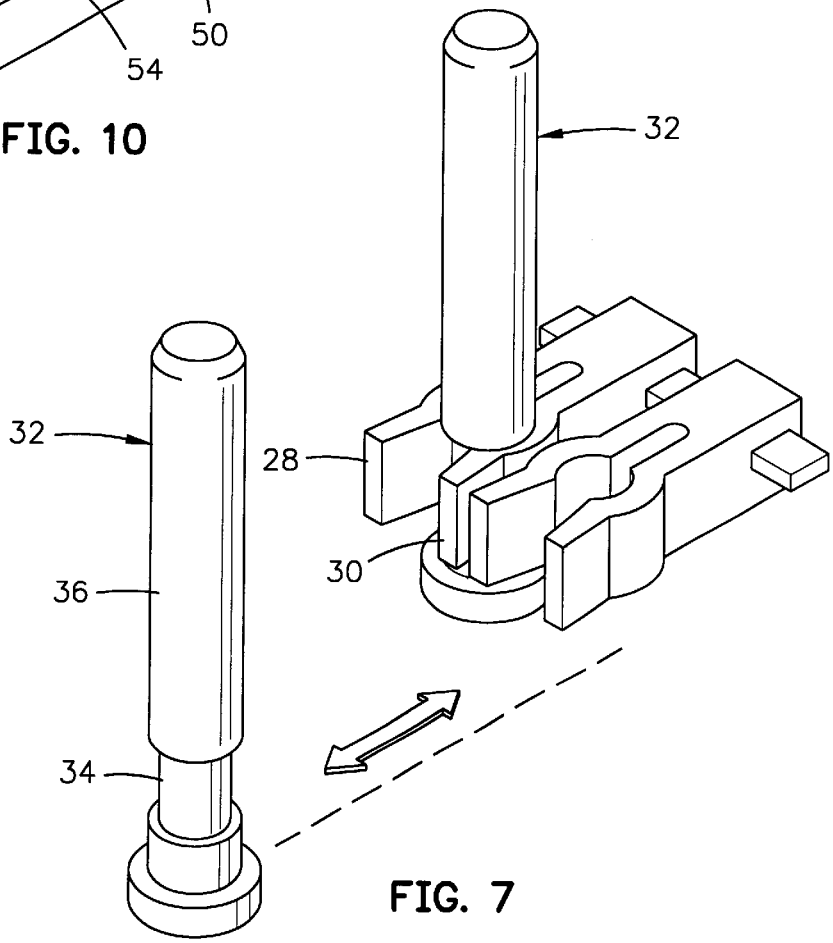
FIGS. 7, 8 and 9 illustrate alternate ways for vertically registering an SMT pin within one of the pin holding segments of the continuous carrier. In each figure the pin is shown it its inserted and extract positions.
Figure 8:
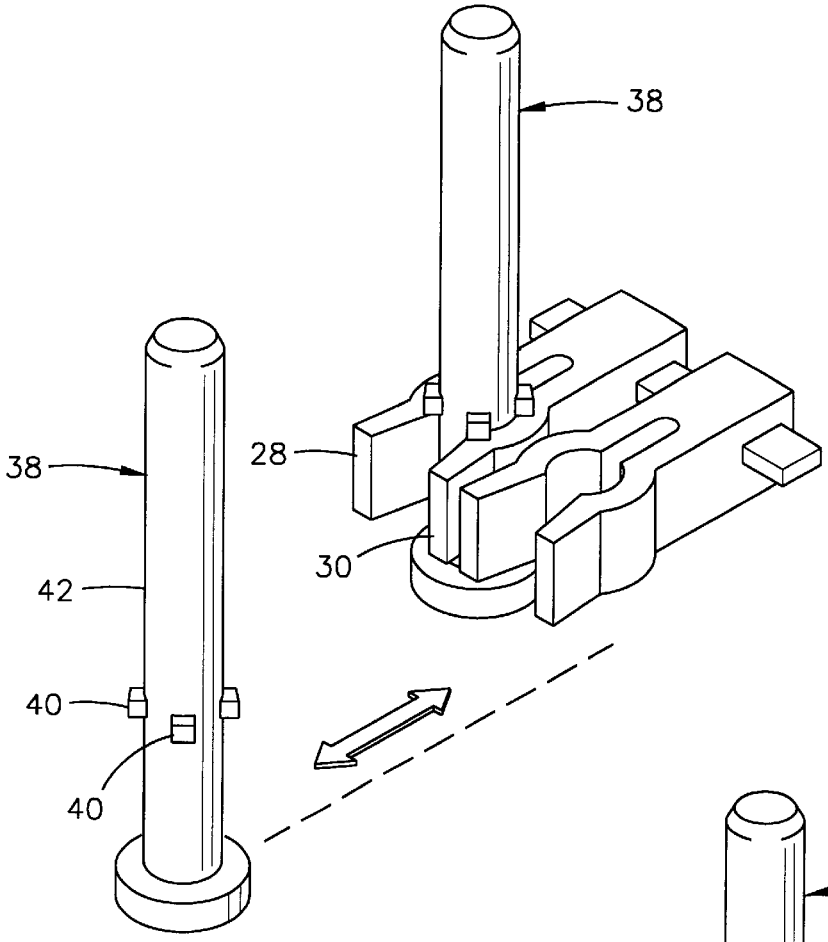
Figure 9:
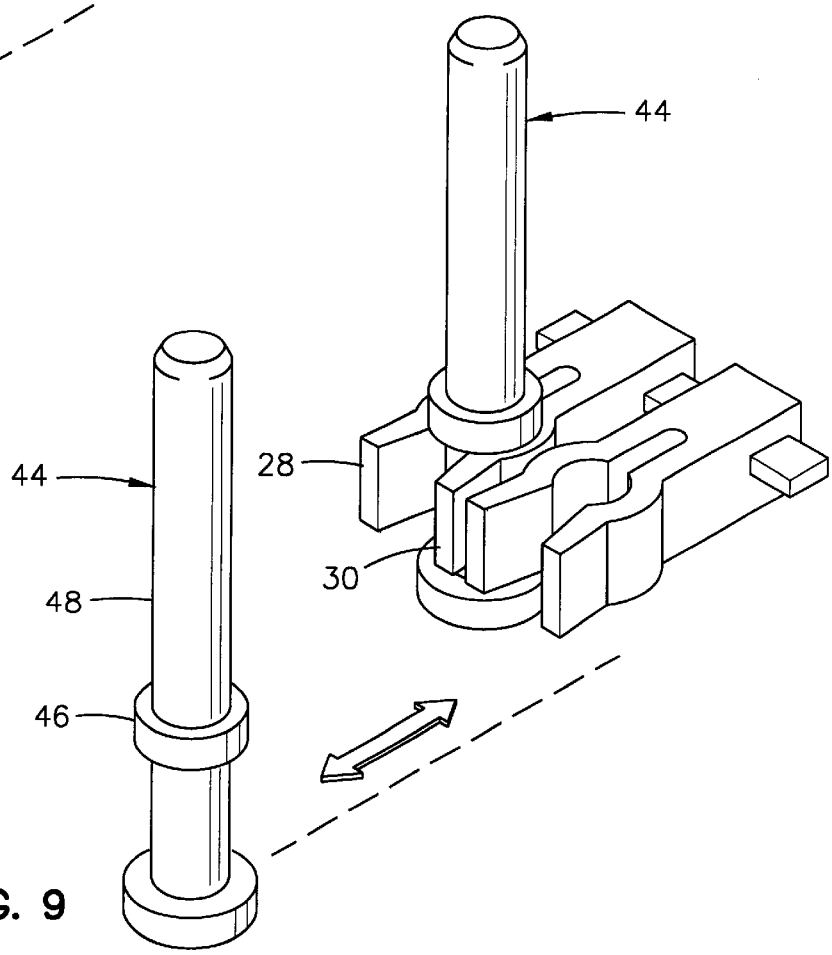

FIGS. 7–9 illustrate alternate forms of the SMT pin 12 with different vertical registration features. In FIG. 7 the pin 32 has an annular groove or recess 34 formed in its shaft 36 for receiving the fingers 28 and 30 of the carrier 14. In FIG. 8, the pin 38 has a plurality of discrete projections 40 formed on its shaft 42 that rest on top of the fingers 28 and 30. In FIG. 9, the pin 44 is formed with an annular flange 46 on its shaft 48. The flange 46 rests on top of the fingers 28 and 30.

Figure 10:
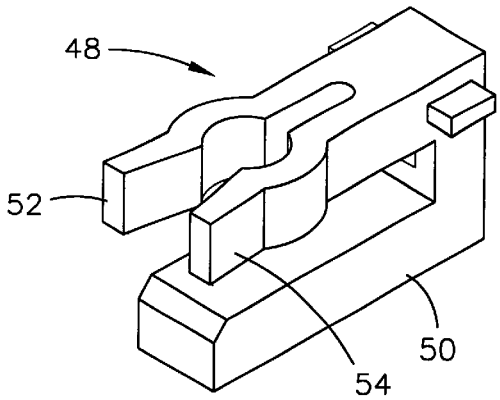
FIG. 10 is a perspective view of an alternate embodiment of one of the pin holding segments of the continuous carrier formed with a pin registration feature.

Referring to FIG. 10, a modified pin holding segment 48 is similar to the pin holding segment 24 except that the former also includes a projection 50 beneath its opposing fingers 52 and 54. The projection 50 engages the terminal end of a corresponding pin to establish a predetermined vertical registration of the pin relative to the strip 14.

Figure 11:
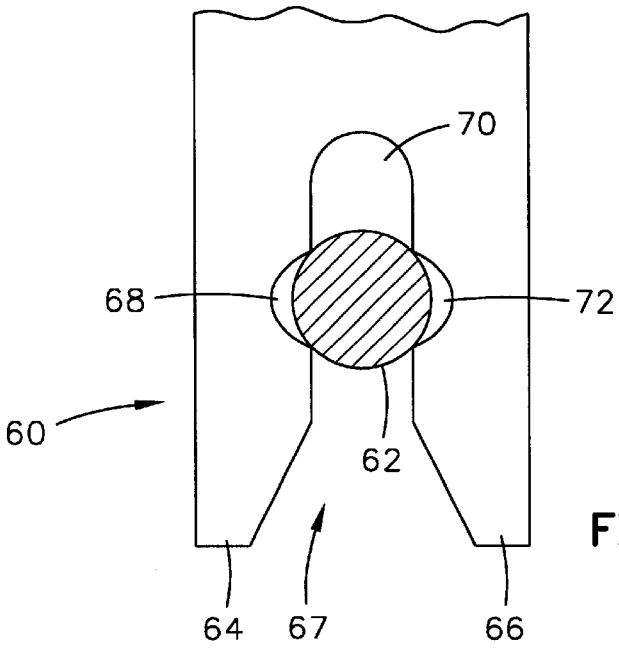
FIG. 11 illustrates another alternate pin holding segment. A cross-section of a pin is shown.

FIG. 11 illustrates an alternate pin holding segment 60 for removably holding a pin 62. The pin holding segment 60 has a resilient opposing fingers 64 and 66 defining a pin receiving receptacle 67 therebetween. The receptacle 67 includes rounded recesses 68, 70 and 72 which are dimensioned and configured so that the pin holding segment 60 grips the pin 62 at four locations spaced ninety degrees apart to center the pin 62.

Figure 12:
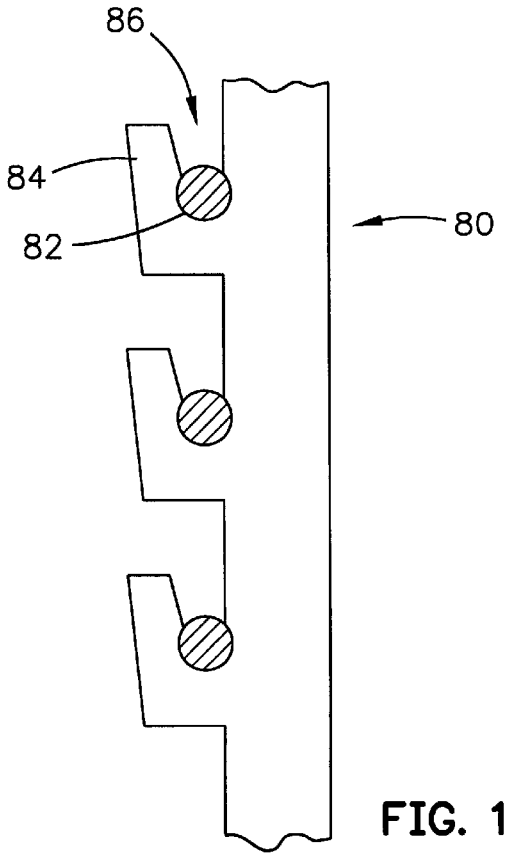
FIG. 12 illustrates an alternate carrier. A cross-section of a pin is shown.

FIG. 12 illustrates an alternate continuous carrier 80 for holding pins 82. A plurality of L-shaped individual resilient fingers 84 extend from a longitudinal spine of the carrier 80. Each finger 84 defines a pin receptacle 86 for removably receiving the corresponding pin 82. The pins 82 are inserted and removed in a direction generally parallel to the longitudinal axis of the spine of the carrier 80. It can thus be seen that an individual resilient finger will suffice to hold a pin in a particular geometry.

While we have described our invention in terms of several preferred embodiments, it should be understood by those skilled in the art that our invention can be further modified in both arrangement and detail. For example, two or more leading segments of one string of the carrier 14 may be molded over a similar number of trailing segments of a preceding string. The carrier can be configured to hold a wide variety of discrete parts besides the SMT pin 12. The carrier could be configured to lock the connector in place instead of frictionally holding the connector. The carrier could be extrusion molded. The carrier could comprise a continuous metal strip with plastic part holding segments attached thereto at intervals. Conversely, a plastic strip with metal part holding segments could be fabricated. Therefore, the protection afforded our invention should only be limited in accordance with the scope of the following claims.

We claim:

1. A continuous carrier of parts, comprising:

a plurality of discrete pins each having a shaft with a longitudinal axis; and a consecutive series of pin holding segments arranged in side-by-side fashion to provide a strip windable about a reel, the strip being continuously injection molded of plastic as a plurality of strings each made up of a predetermined number of pin holding segments with a forward portion of each string, except for leading string of the strip, being molded over a trailing portion of a preceding string, each pin holding segment having a receptacle formed by a pair of opposing resilient fingers for frictionally removably holding a shaft of a corresponding pin so that the pin can be inserted and removed in a direction substantially normal to the longitudinal axis of the shaft, and each pin holding segment being spaced from and parallel to an adjacent pin holding segment, and being configured as a substantially rectangular body having at least one shoulder providing a drive surface for engagement by a drive member of a feeder for advancing the strip.

2. The continuous carrier of parts of claim 1 wherein each pin holding segment is further configured to provide a projection for engaging a corresponding pin to establish a registration of the pin relative to the strip.

3. The continuous carrier of parts of claim 2 wherein the projection engages a terminal end of the shaft of the corresponding pin.

4. The continuous carrier of parts of claim 1 wherein the pins each have a base formed on an underside with radially extending solder flux vapor venting channels.

5. The continuous carrier of parts of claim 1 wherein the receptacle of each pin holding segment is formed by arcuate recesses in the fingers, the recesses having a diameter matching a diameter of the shaft of the pins.

6. The continuous carrier of parts of claim 1 wherein each pin has a base and each pin holding segment is formed with an L-shaped projection that engages the base of the corresponding pin.

7. The continuous carrier of parts of claim 1 wherein the shaft of each pin is formed with an annular recess for receiving the fingers of a corresponding pin holding segment.

8. The continuous carrier of parts of claim 1 wherein the shaft of each pin is formed with a plurality of discrete projections that engage the fingers of a corresponding pin holding segment.

9. The continuous carrier of parts of claim 1 wherein the shaft of each pin is formed with an annular flange that engages the fingers of a corresponding pin holding segment.

10. The continuous carrier of parts of claim 1 wherein each trailing portion has a hole to ensure an interlock when molded over.

11. The continuous carrier of parts of claim 1 wherein each string is comprised of eight pin holding segments.

* * * * *